US010046198B1

(12) United States Patent
Huang

(10) Patent No.: US 10,046,198 B1
(45) Date of Patent: Aug. 14, 2018

(54) WHEEL EXERCISING DEVICE

(71) Applicant: JSS Sports Co., Ltd., Chang-Hwa Hsien (TW)

(72) Inventor: Chin-Chen Huang, Fuxing Township (TW)

(73) Assignee: JSS Sports Co., Ltd., Chang-Hwa Hsien (TW)

( * ) Notice: Subject to any disclaimer, the term of this patent is extended or adjusted under 35 U.S.C. 154(b) by 0 days.

(21) Appl. No.: 15/430,599

(22) Filed: Feb. 13, 2017

(51) Int. Cl.
*A63B 21/02* (2006.01)
*A63B 22/20* (2006.01)
*A63B 21/055* (2006.01)
*A63B 21/00* (2006.01)

(52) U.S. Cl.
CPC ..... *A63B 22/20* (2013.01); *A63B 21/023* (2013.01); *A63B 21/0552* (2013.01); *A63B 21/4035* (2015.10); *A63B 21/4043* (2015.10)

(58) Field of Classification Search
CPC ..... A63B 21/0004; A63B 21/05; A63B 21/40; A63B 23/1236; A63B 22/20
USPC ..... 482/13, 51, 66, 68, 92, 120–131, 132, 482/141
See application file for complete search history.

(56) References Cited

U.S. PATENT DOCUMENTS 285,476 A * 9/1883 Prink ..... F28F 5/02 165/89
1,247,162 A * 11/1917 Southwick ..... A21C 3/021 492/14
2,920,418 A * 1/1960 Britt ..... A63B 21/0004 446/241
3,831,238 A * 8/1974 Adams ..... A21C 3/021 492/14
3,938,803 A * 2/1976 Wilmoth ..... A63B 21/05 482/127
4,314,395 A * 2/1982 Brock ..... B44C 7/06 15/230.11
4,639,961 A * 2/1987 Chasan ..... A47C 27/085 5/673
4,862,542 A * 9/1989 Jordan ..... A47C 21/00 5/673
5,000,671 A * 3/1991 Nolte ..... B28B 3/12 134/68
5,152,731 A * 10/1992 Troutman ..... A63B 21/0724 482/106
5,261,866 A * 11/1993 Mattox ..... A63B 21/0552 482/125
5,334,118 A * 8/1994 Dantolan ..... A63B 15/005 482/109

(Continued)

*Primary Examiner* — Garrett Atkinson
(74) *Attorney, Agent, or Firm* — Alan D. Kamrath; Kamrath IP Lawfirm, P.A.

(57) ABSTRACT

A wheel exercising device includes a shank, two handgrips, two wheels, and two caps. The shank has a first threaded section and a second threaded section having different screwing directions. Each of the two handgrips is formed with an internal threaded section screwed onto the first threaded section and the second threaded section of the shank. At least one elastic member is connected between the two handgrips. Each of the two wheels is mounted on the shank. Each of the two caps is mounted on the shank and rests on one of the two wheels. When the two wheels are rotated forward and backward, the two handgrips are moved inward and outward synchronously along the first threaded section and the second threaded section of the shank.

12 Claims, 11 Drawing Sheets

(56) References Cited

U.S. PATENT DOCUMENTS 5,499,961 A * 3/1996 Mattox ..... A63B 21/055 482/123
6,280,369 B1 * 8/2001 Gibran ..... A21C 3/021 492/14
6,638,201 B1 * 10/2003 Dischler ..... A63B 22/20 482/132
7,175,573 B1 * 2/2007 Huang ..... A63B 21/0004 446/236
7,175,575 B1 * 2/2007 Dantolen ..... A63B 15/005 482/121
7,322,905 B2 * 1/2008 Morris ..... A63B 23/047 482/118
7,387,599 B1 * 6/2008 Hsu ..... A61H 15/0092 482/122
7,404,228 B2 * 7/2008 Hodges ..... B05C 17/0217 15/230.11
8,137,251 B2 * 3/2012 Tozzi ..... A63B 22/203 482/132
D688,337 S * 8/2013 Huang ..... D21/662
8,550,965 B2 * 10/2013 Candela ..... A63B 23/0211 482/132
8,894,555 B2 * 11/2014 Colledge ..... A63B 21/0004 482/118
D794,725 S * 8/2017 Lamothe ..... D21/679
9,808,665 B1 * 11/2017 Demarais ..... A63B 21/4035
2002/0111256 A1 * 8/2002 Tuller ..... A63B 21/026 482/140
2003/0050153 A1 * 3/2003 Stevens ..... A63B 21/025 482/92
2003/0134726 A1 * 7/2003 Yu ..... A63B 21/00043 482/110
2003/0158023 A1 * 8/2003 Yu ..... A63B 21/0004 482/126
2004/0040111 A1 * 3/2004 Er ..... B05C 17/0217 15/230.11
2005/0202944 A1 * 9/2005 Deal ..... A61H 15/0092 482/126
2008/0167168 A1 * 7/2008 Hurst ..... A63B 21/0728 482/132
2009/0064436 A1 * 3/2009 Scott, Sr. ..... B05C 17/0217 15/230.11
2011/0160024 A1 * 6/2011 Candela ..... A63B 23/0211 482/132
2012/0100969 A1 * 4/2012 Brodbeck ..... A63B 22/20 482/132
2013/0095984 A1 * 4/2013 Agate ..... A63B 21/0618 482/106

* cited by examiner

WHEEL EXERCISING DEVICE

BACKGROUND OF THE INVENTION

1. Field of the Invention

The present invention relates to a small-size exercising device and, more particularly, to a wheel exercising device.

2. Description of the Related Art

A conventional wheel exercising device 40 in accordance with the prior art shown in FIG. 11 comprises a shank 41 and two wheels 42 each mounted on the shank 41 by a screw cover 43. The shank 41 is formed with two rough surfaces 44 to facilitate the user holding the shank 41. When in use, the user's two feet are placed on the ground, and the user's two hands hold and apply a force on the shank 41 to drive and move the two wheels 42 on the ground. In such a manner, the user has to apply a determined force to move and rotate the two wheels 42 forward and backward, so as to exercise the user's body. However, the distance between the two rough surfaces 44 is fixed so that the user's two arms are kept a constant width, thereby decreasing the variation and amusement of the exercising process. In addition, the two wheels 42 are rotated relative to the shank 41, and the clearance between each of the two wheels 42 and the shank 41 has to be controlled exactly, so that the screw covers 43 are detached from the two wheels 42 only when it is necessary. Further, it is difficult to detach the screw covers 43 from the two wheels 42.

BRIEF SUMMARY OF THE INVENTION

The primary objective of the present invention is to provide a wheel exercising device that has an enhanced exercising effect, and is assembled and disassembled easily and quickly.

In accordance with the present invention, there is provided a wheel exercising device comprising a shank, two handgrips mounted on the shank, two wheels mounted on the shank, and two caps mounted on the shank and resting on the two wheels. The shank has a surface formed with a first threaded section and a second threaded section having a screwing direction opposite to that of the first threaded section. The shank is provided with a stop portion located between the first threaded section and the second threaded section. The shank has two ends each provided with a connecting portion. Each of the two handgrips is formed with a through hole mounted on the first threaded section and the second threaded section of the shank. The through hole of each of the two handgrips has a peripheral wall formed with an internal threaded section screwed onto the first threaded section and the second threaded section of the shank. Each of the two handgrips is formed with a connecting ring directed toward the stop portion of the shank. At least one elastic member is connected between the connecting rings of the two handgrips. Each of the two wheels has a center provided with an axial hole mounted on the respective connecting portion of the shank. Each of the two caps is mounted on the respective connecting portion of the shank and rests on one of the two wheels. In practice, when the two wheels are rotated forward and backward, the two handgrips are moved inward and outward synchronously along the first threaded section and the second threaded section of the shank, and the at least one elastic member provides a pulling force between the two handgrips to pull the two handgrips toward the stop portion of the shank.

According to the primary advantage of the present invention, when the two wheels are rotated backward, the two handgrips are moved outward relative to each other, and when the two wheels are rotated forward, the two handgrips are moved toward each other, so that the two handgrips displace sideward on the shank during rotation of the two wheels, thereby enhancing variation and amusement of the wheel exercising device during the exercising process, and thereby exercising more part of the user's body, so as to enhance the exercising effect.

According to another advantage of the present invention, the at least one elastic member provides a restoring force to the two handgrips so that the user operates the two handgrips in an energy-saving manner.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
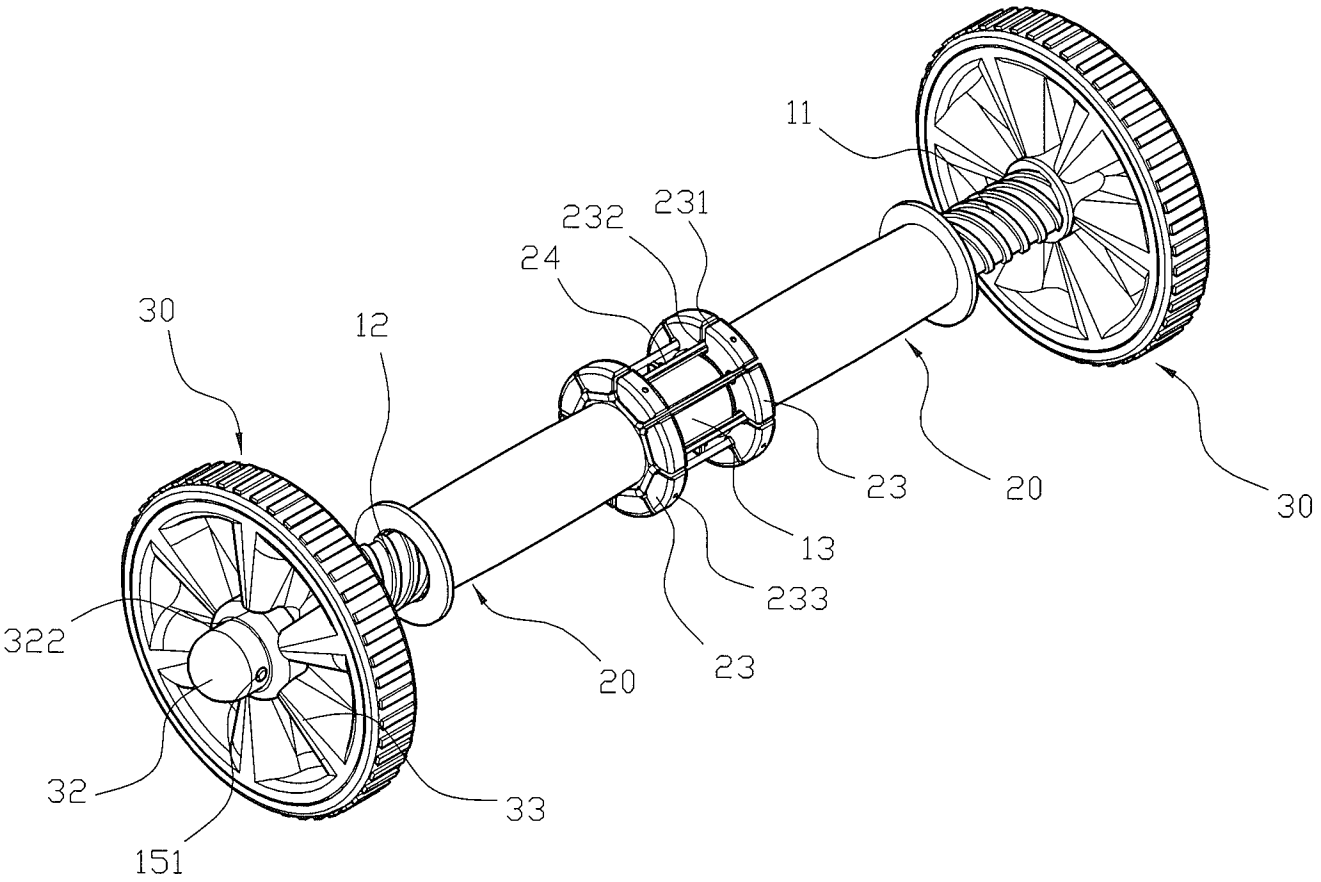
FIG. 1 is a perspective view of a wheel exercising device in accordance with the preferred embodiment of the present invention.
Figure 2:
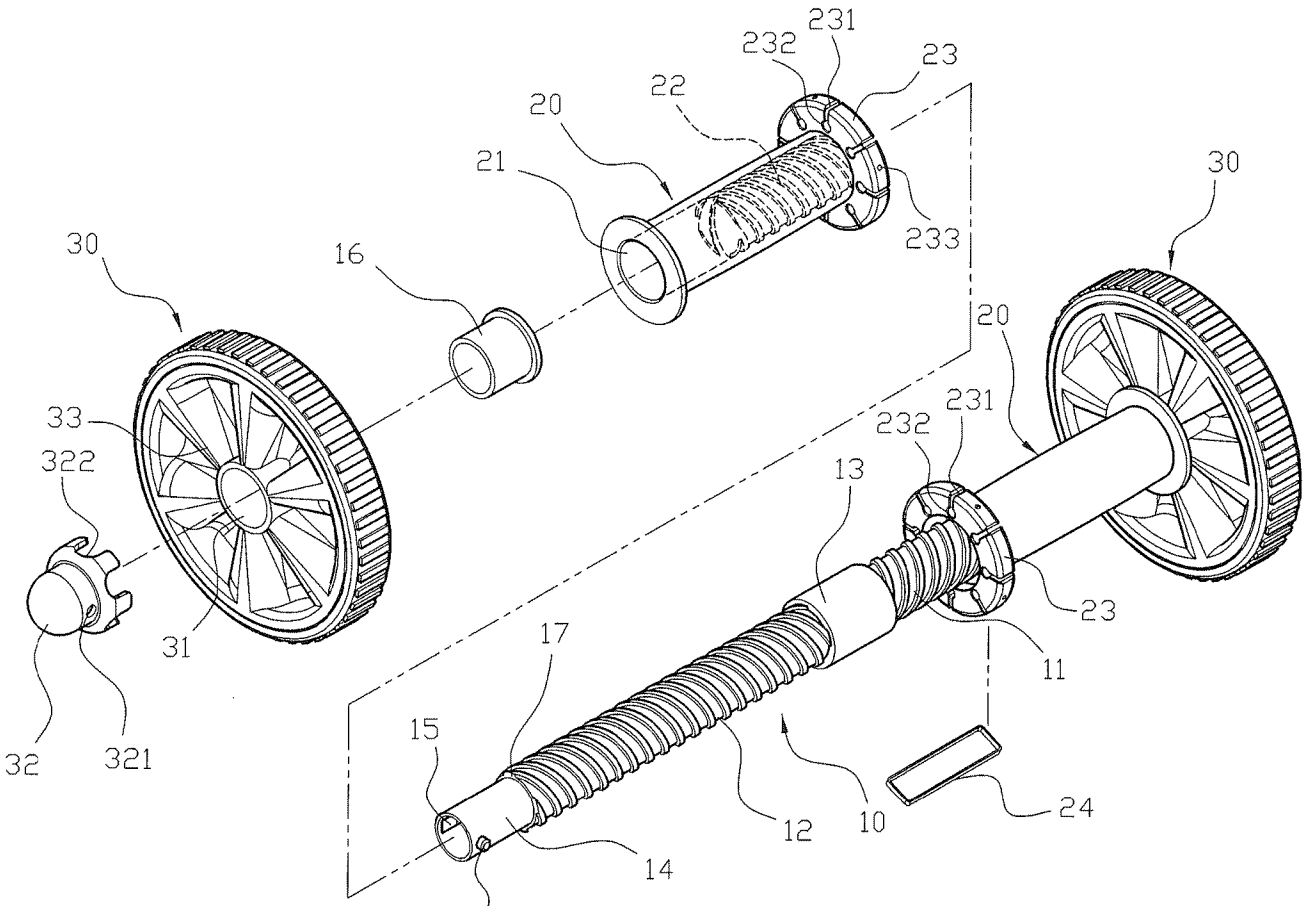
FIG. 2 is an exploded perspective view of the wheel exercising device as shown in FIG. 1.
Figure 3:
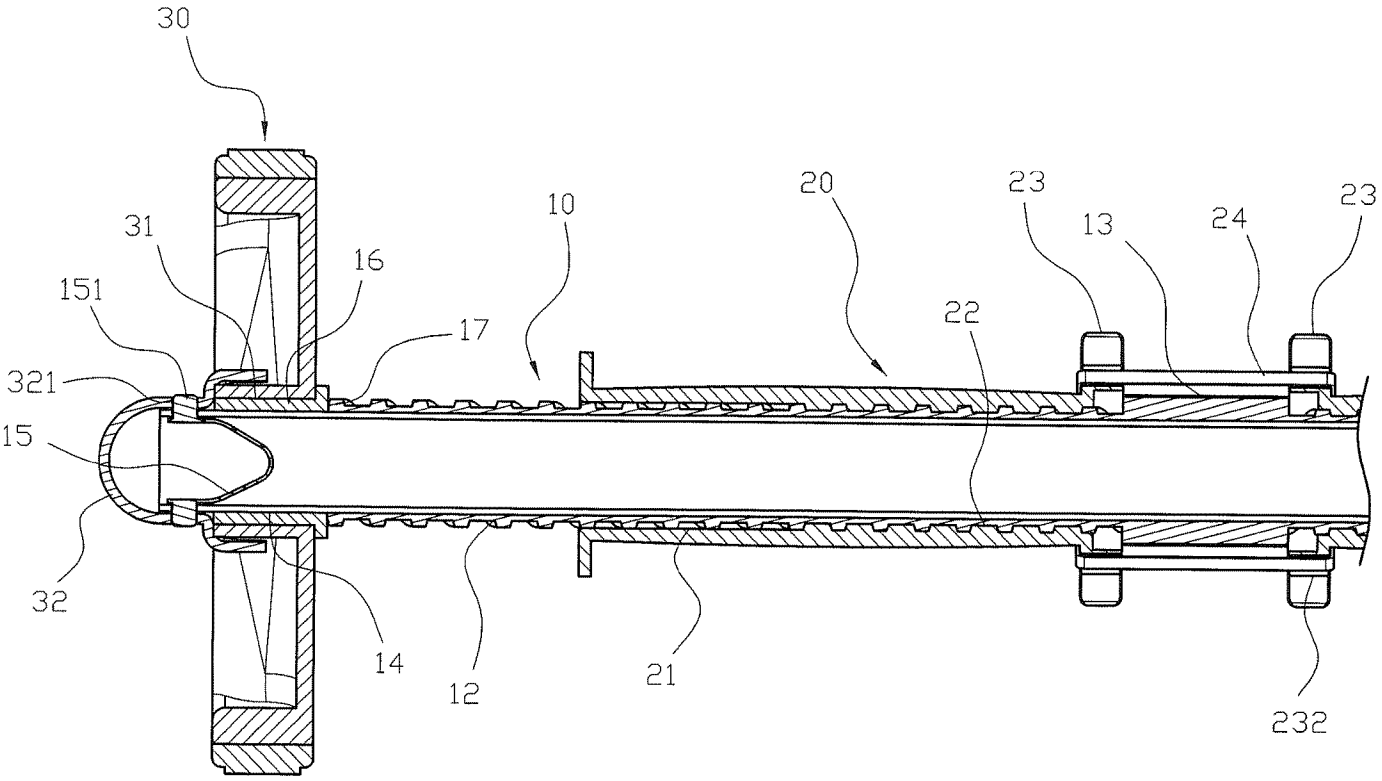
FIG. 3 is a partially cross-sectional view of the wheel exercising device as shown in FIG. 1.

Referring to the drawings and initially to FIGS. 1-3, a wheel exercising device in accordance with the preferred embodiment of the present invention comprises a shank 10, two handgrips 20 mounted on the shank 10, two wheels 30 mounted on the shank 10, and two caps 32 mounted on the shank 10 and resting on the two wheels 30.

The shank 10 has a surface formed with a first threaded section 11 and a second threaded section 12 having a screwing direction opposite to that of the first threaded section 11. The first threaded section 11 and the second threaded section 12 of the shank 10 are arranged symmetrically. The shank 10 is provided with a stop portion 13 located between the first threaded section 11 and the second threaded section 12. The shank 10 has two ends each provided with a connecting portion 14 juxtaposed to the first threaded section 11 and the second threaded section 12. Each of the first threaded section 11 and the second threaded section 12 of the shank 10 is provided with a stop flange 17 juxtaposed to the respective connecting portion 14.

Each of the two handgrips 20 is formed with a through hole 21 mounted on the first threaded section 11 and the second threaded section 12 of the shank 10. The through hole 21 of each of the two handgrips 20 has a peripheral wall formed with an internal threaded section 22 screwed onto the first threaded section 11 and the second threaded section 12 of the shank 10. Each of the two handgrips 20 is formed with a connecting ring 23 directed toward the stop portion 13 of the shank 10. At least one elastic member 24 is connected between the connecting rings 23 of the two handgrips 20.

Each of the two wheels 30 is located between the respective stop flange 17 of the shank 10 and one of the two caps 32. Each of the two wheels 30 has a center provided with an axial hole 31 mounted on the respective connecting portion 14 of the shank 10. Each of the two caps 32 is mounted on the respective connecting portion 14 of the shank 10 and rests on one of the two wheels 30.

In practice, when the two wheels 30 are rotated forward and backward, the two handgrips 20 are moved inward and outward synchronously along the first threaded section 11 and the second threaded section 12 of the shank 10, and the at least one elastic member 24 provides a pulling force between the two handgrips 20 to pull the two handgrips 20 toward the stop portion 13 of the shank 10, so as to enhance the exercising effect of wheel movement.

In the preferred embodiment of the present invention, each of the two caps 32 is provided with two apertures 321, and the respective connecting portion 14 of the shank 10 has an interior provided with a substantially U-shaped elastic plate 15 which has two ends each provided with a boss 151 which protrudes from the respective connecting portion 14 and is inserted into each of the two apertures 321 to form a quick release structure between each of the two wheels 30 and the shank 10. Thus, the two wheels 30 and the shank 10 are combined by the two caps 32.

In the preferred embodiment of the present invention, the wheel exercising device further comprises two bushings 16 each mounted between the respective connecting portion 14 of the shank 10 and the axial hole 31 of one of the two wheels 30.

In the preferred embodiment of the present invention, each of the two wheels 30 is formed with a plurality of spokes 33 extending outward from the axial hole 31 in a radiating manner. Each of the two caps 32 is formed with a plurality of retaining grooves 322 directed toward and mounted on the spokes 33 of one of the two wheels 30, so that the two caps 32 and the two wheels 30 are rotated synchronously.

In the preferred embodiment of the present invention, the connecting ring 23 of each of the two handgrips 20 is formed with a plurality of slits 231 arranged in a radiating manner. Each of the slits 231 allows entrance of the at least one elastic member 24 and has a bottom formed with a positioning hole 232 for limiting the at least one elastic member 24.

In the preferred embodiment of the present invention, the at least one elastic member 24 is an elastic loop extending through four adjacent positioning holes 232 of the two handgrips 20.

In assembly, the through holes 21 of the two handgrips 20 are mounted on the first threaded section 11 and the second threaded section 12 of the shank 10, with the connecting ring 23 of each of the two handgrips 20 directed toward the stop portion 13 of the shank 10, so that the internal threaded sections 22 of the two handgrips 20 are screwed onto the first threaded section 11 and the second threaded section 12 of the shank 10. Then, the at least one elastic member 24 is connected between the connecting rings 23 of the two handgrips 20, so that the at least one elastic member 24 provides a pulling force between the two handgrips 20 to pull the two handgrips 20 toward the stop portion 13 of the shank 10. At this time, the at least one elastic member 24 extends through the slits 231 into the positioning holes 232 and is limited in the positioning holes 232. Then, each of the two bushings 16 is inserted into the axial hole 31 of one of the two wheels 30 and is mounted on the respective connecting portion 14 of the shank 10, so that each of the two wheels 30 rests on the respective stop flange 17 of the shank 10. Thus, the two wheels 30 are mounted on the two ends of the shank 10. Then, each of the two caps 32 is mounted on the respective connecting portion 14 of the shank 10, with the retaining grooves 322 of each of the two caps 32 being locked on the spokes 33 of one of the two wheels 30. At this time, the respective boss 151 of the U-shaped elastic plate 15 protrudes from the respective connecting portion 14 and is inserted into each of the two apertures 321, so that the shank 10, the two wheels 30 and the two caps 32 are combined together quickly. In such a manner, each of the two handgrips 20 is limited to move between one of the two wheels 30 and the stop portion 13 of the shank 10. In addition, when respective the boss 151 of the U-shaped elastic plate 15 is pressed and retracted inward to detach from each of the two apertures 321, the two caps 32 are released from the shank 10, so that the two wheels 30 can be removed from the shank 10. Then, the at least one elastic member 24 can be detached from the two handgrips 20, and the two handgrips 20 can be unscrewed from the shank 10.

Figure 4:
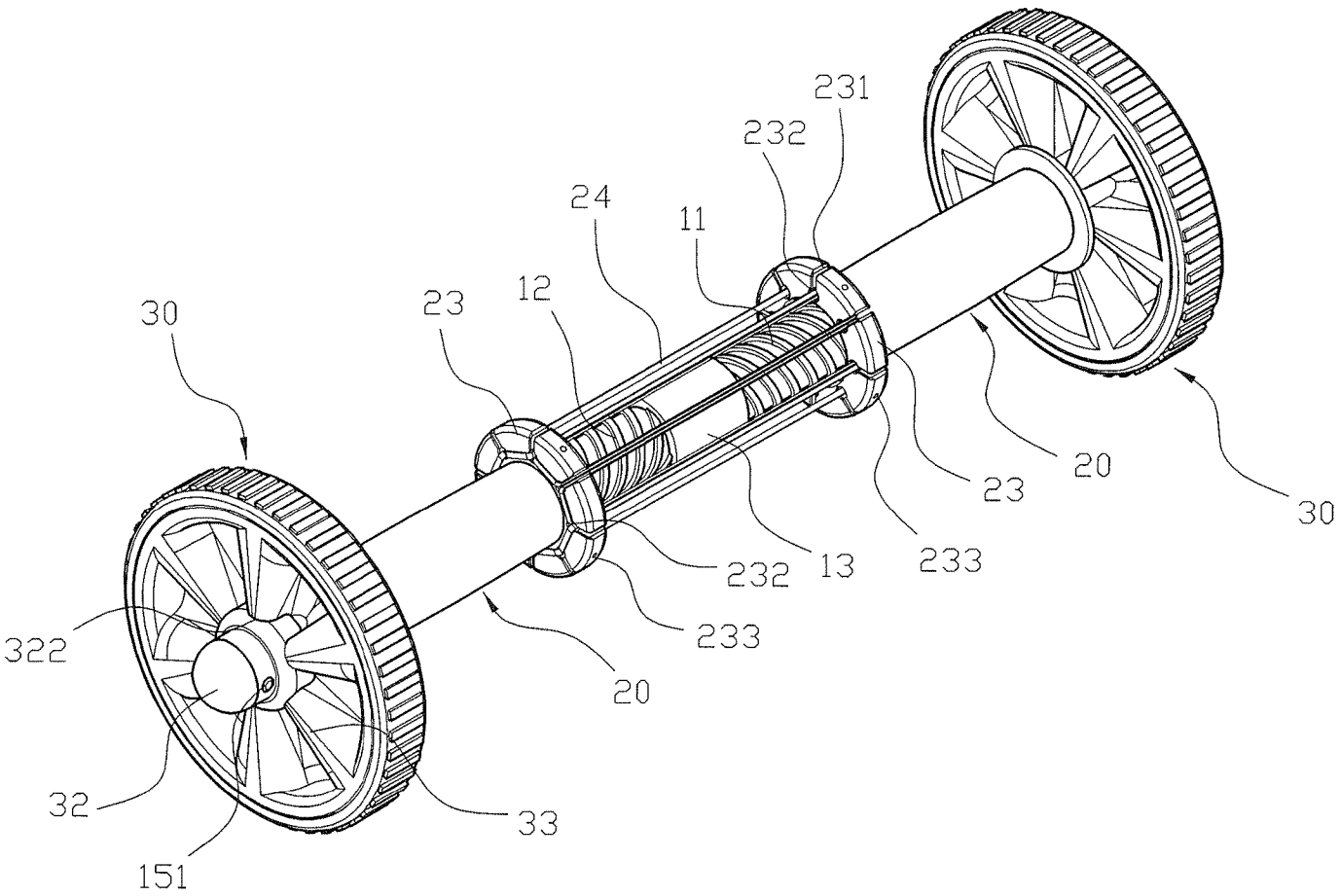
FIG. 4 is a first schematic operational view of the wheel exercising device as shown in FIG. 1 in use.
Figure 5:
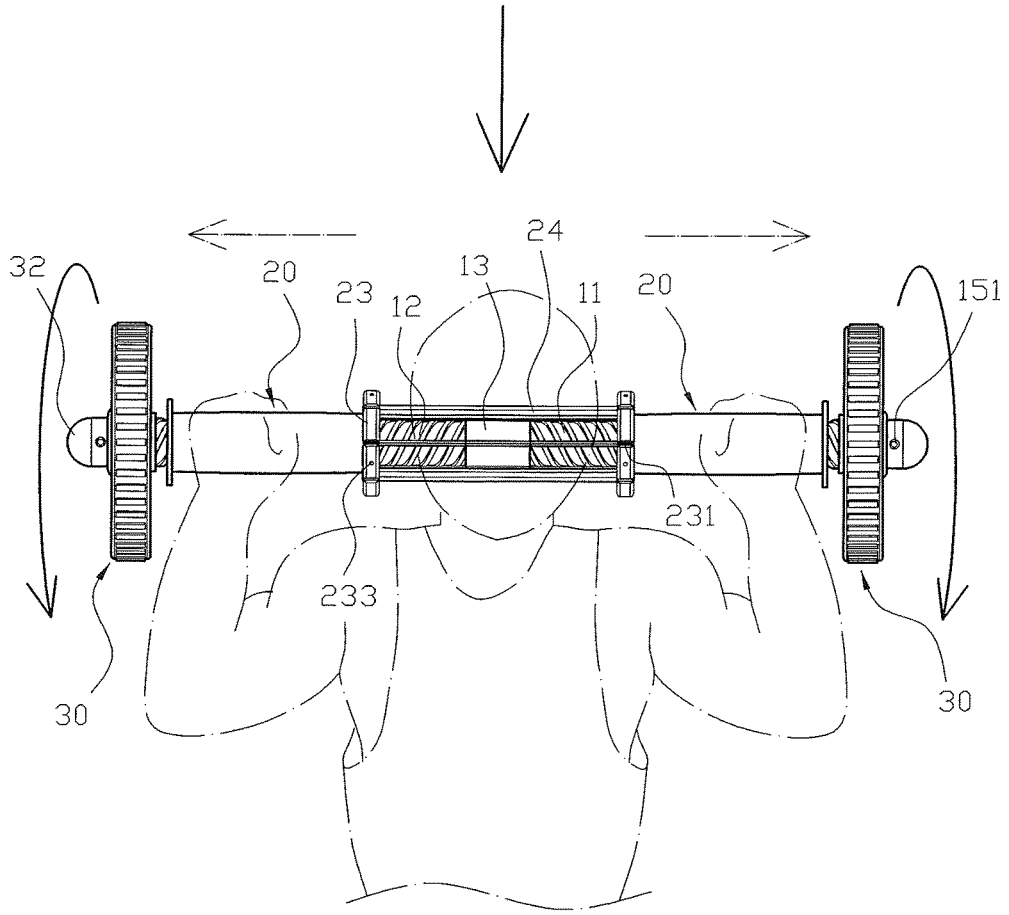
FIG. 5 is a second schematic operational view of the wheel exercising device as shown in FIG. 1 in use.
Figure 6:
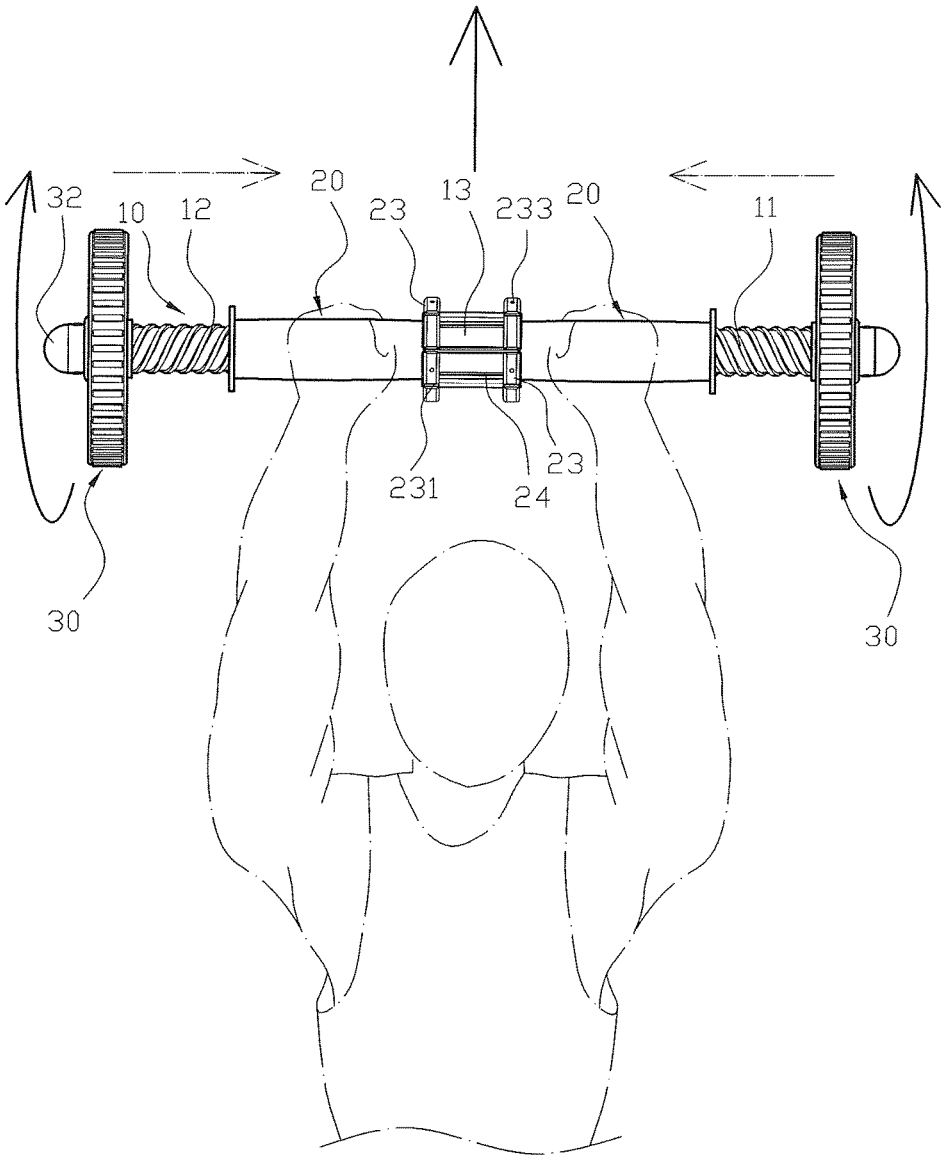
FIG. 6 is a third schematic operational view of the wheel exercising device as shown in FIG. 1 in use.

In operation, referring to FIGS. 4-6 with reference to FIGS. 1-3, the user's two feet are placed on the ground, and the user's two hands hold and apply a force on the two handgrips 20 to drive and move the two wheels 30 on the ground. In such a manner, the user has to apply a determined force to move the two wheels 30 forward and backward, so as to exercise the user's body. At this time, the internal threaded sections 22 of the two handgrips 20 are screwed onto the first threaded section 11 and the second threaded section 12 of the shank 10. Thus, when the two wheels 30 are rotated backward as shown in FIG. 5, the two handgrips 20 are moved on the first threaded section 11 and the second threaded section 12 of the shank 10, and are moved outward toward the two wheels 30, while the at least one elastic member 24 is extended by the two handgrips 20. On the contrary, when the two wheels 30 are rotated forward as shown in FIG. 6, the two handgrips 20 are moved on the first threaded section 11 and the second threaded section 12 of the shank 10, and are moved inward toward the stop portion 13 of the shank 10, while the at least one elastic member 24 is retracted elastically.

Figure 7:
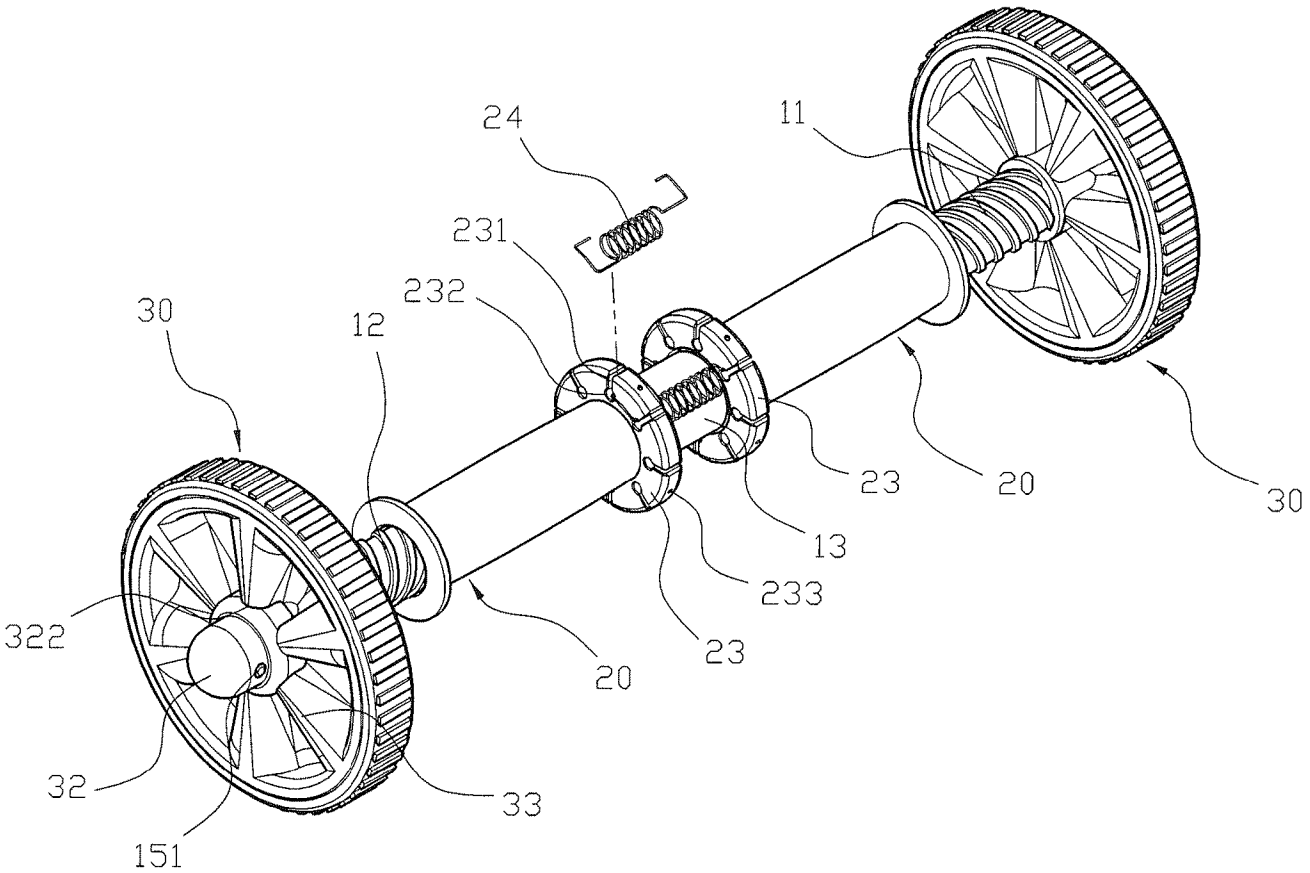
FIG. 7 is a partially exploded perspective view of a wheel exercising device in accordance with another preferred embodiment of the present invention.

Referring to FIG. 7, the at least one elastic member 24 is a tension spring hooked between two opposite positioning holes 232 of the two handgrips 20.

Figure 8:
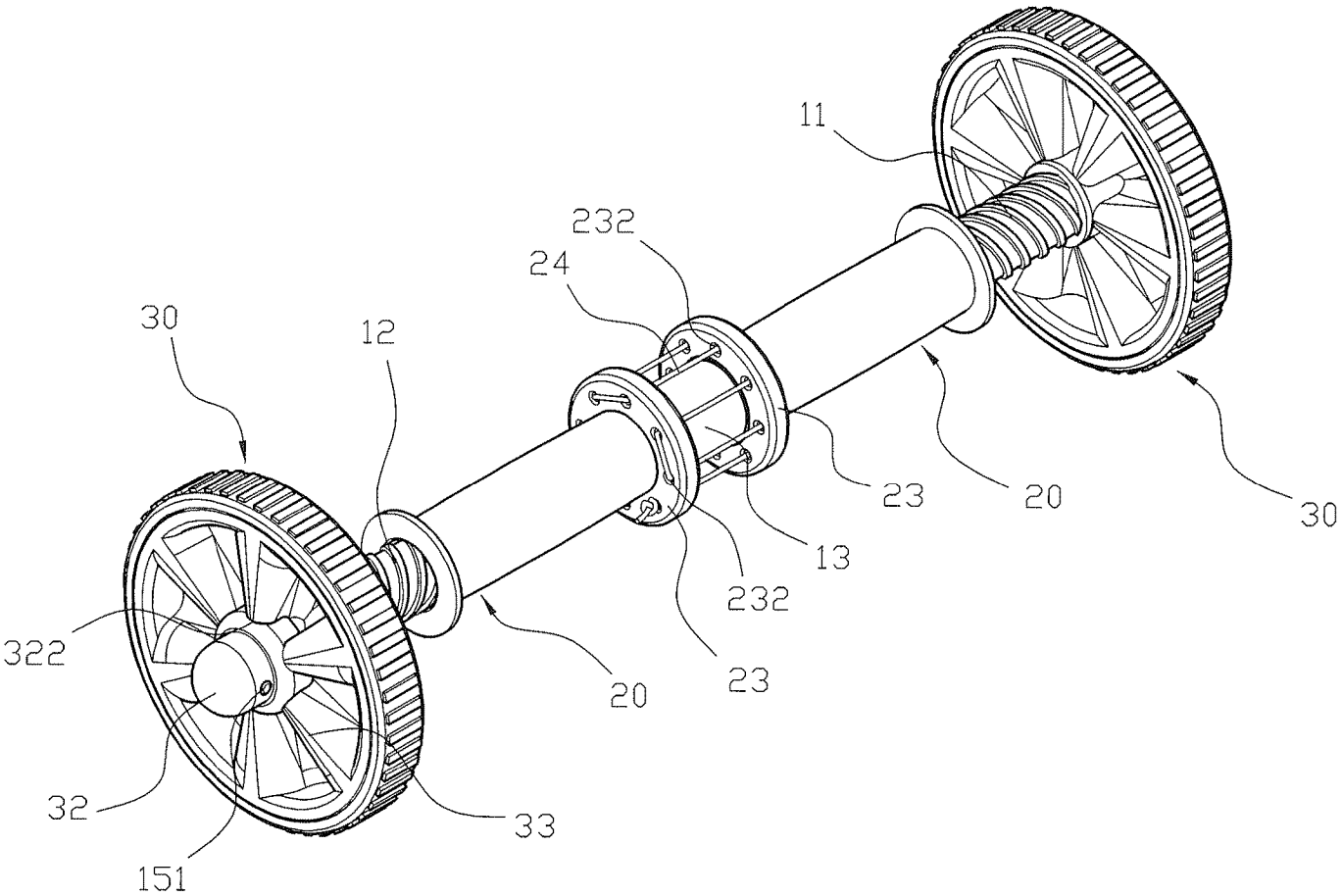
FIG. 8 is a partially exploded perspective view of a wheel exercising device in accordance with another preferred embodiment of the present invention.

Referring to FIG. 8, the connecting ring 23 of each of the two handgrips 20 is directly formed with a plurality of positioning holes 232 for fixing the at least one elastic member 24. The at least one elastic member 24 is an elastic cord extending through all of positioning holes 232 of the two handgrips 20.

Figure 9:
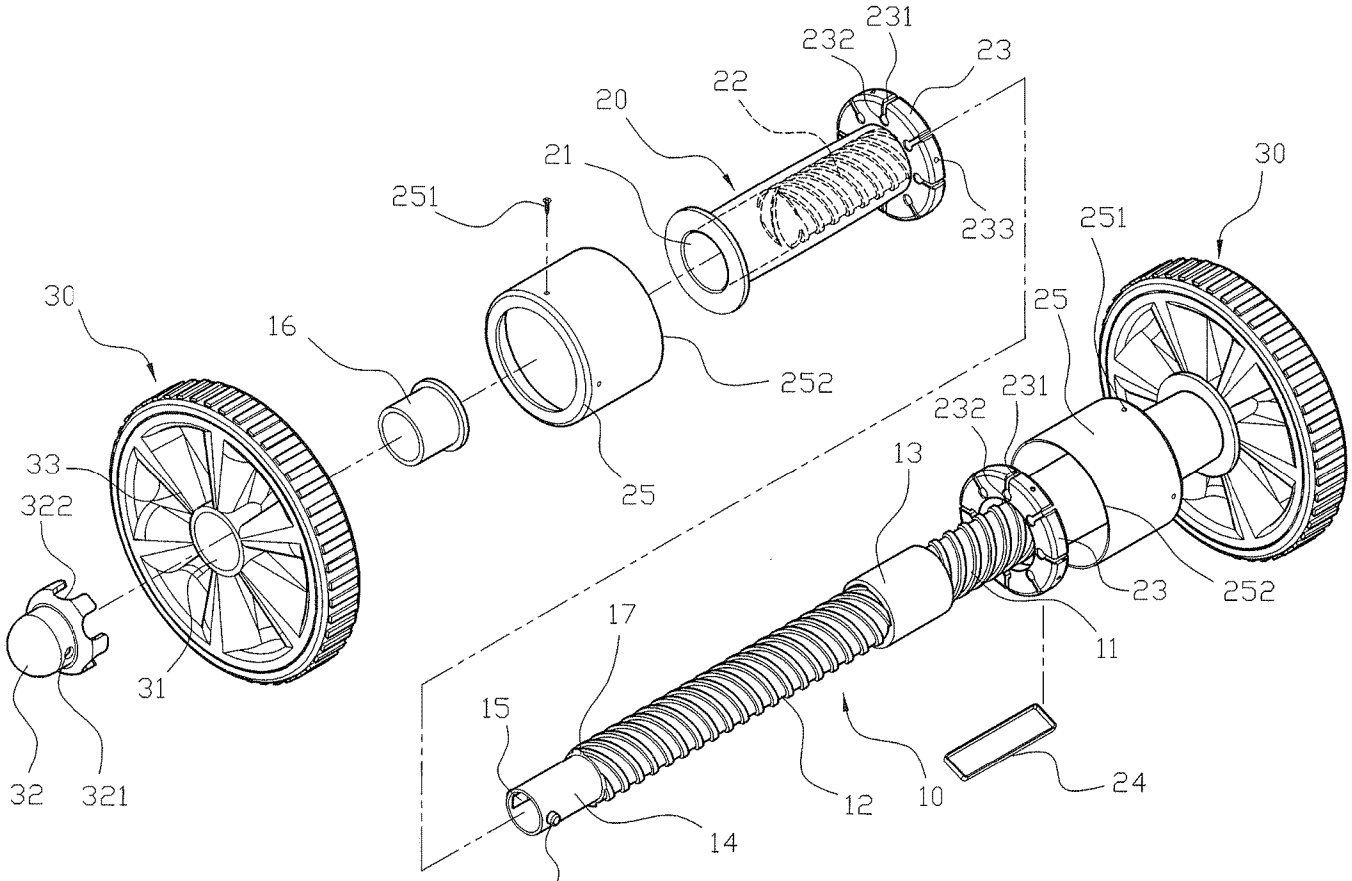
FIG. 9 is an exploded perspective view of a wheel exercising device in accordance with another preferred embodiment of the present invention.
Figure 10:
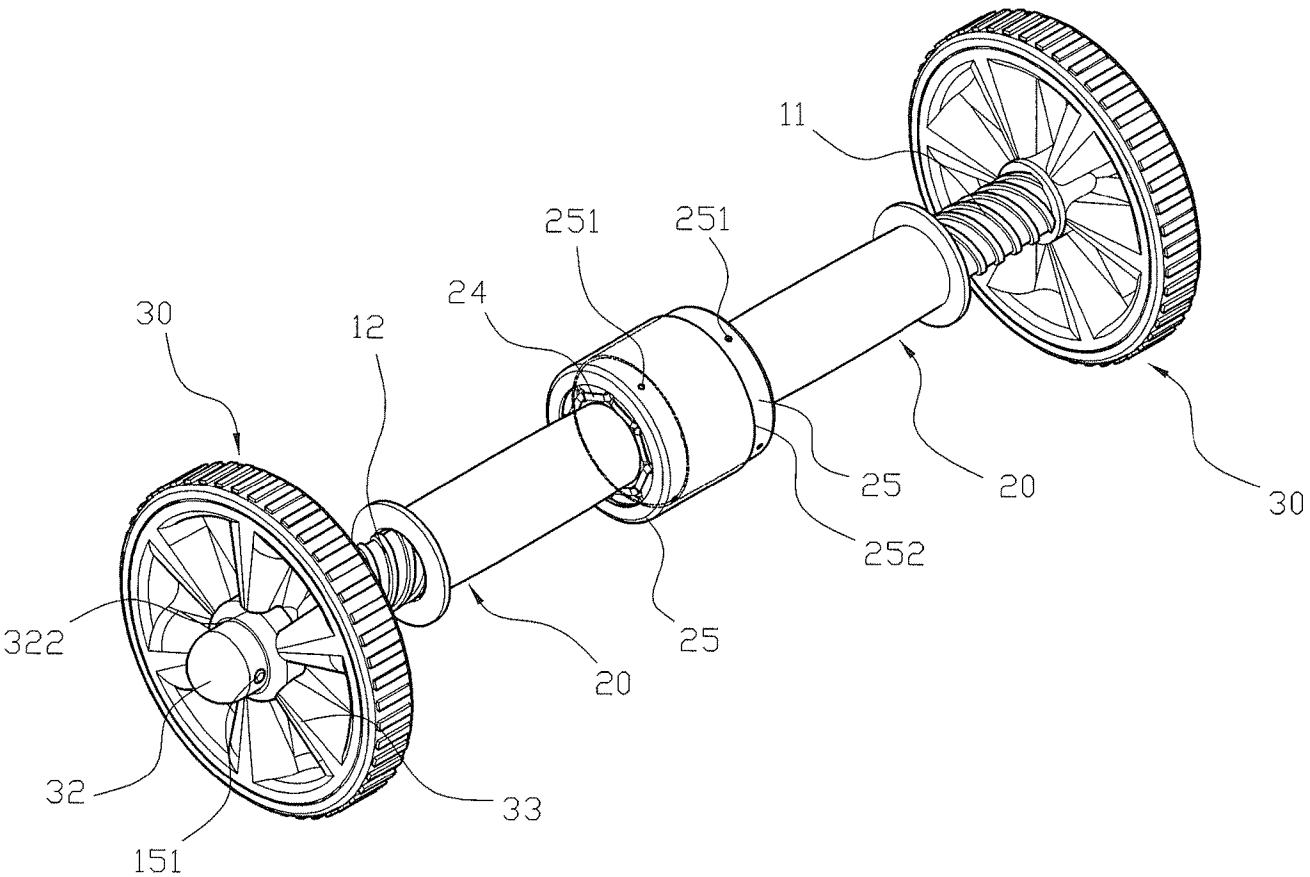
FIG. 10 is a perspective assembly view of the wheel exercising device as shown in FIG. 9.
Figure 11:
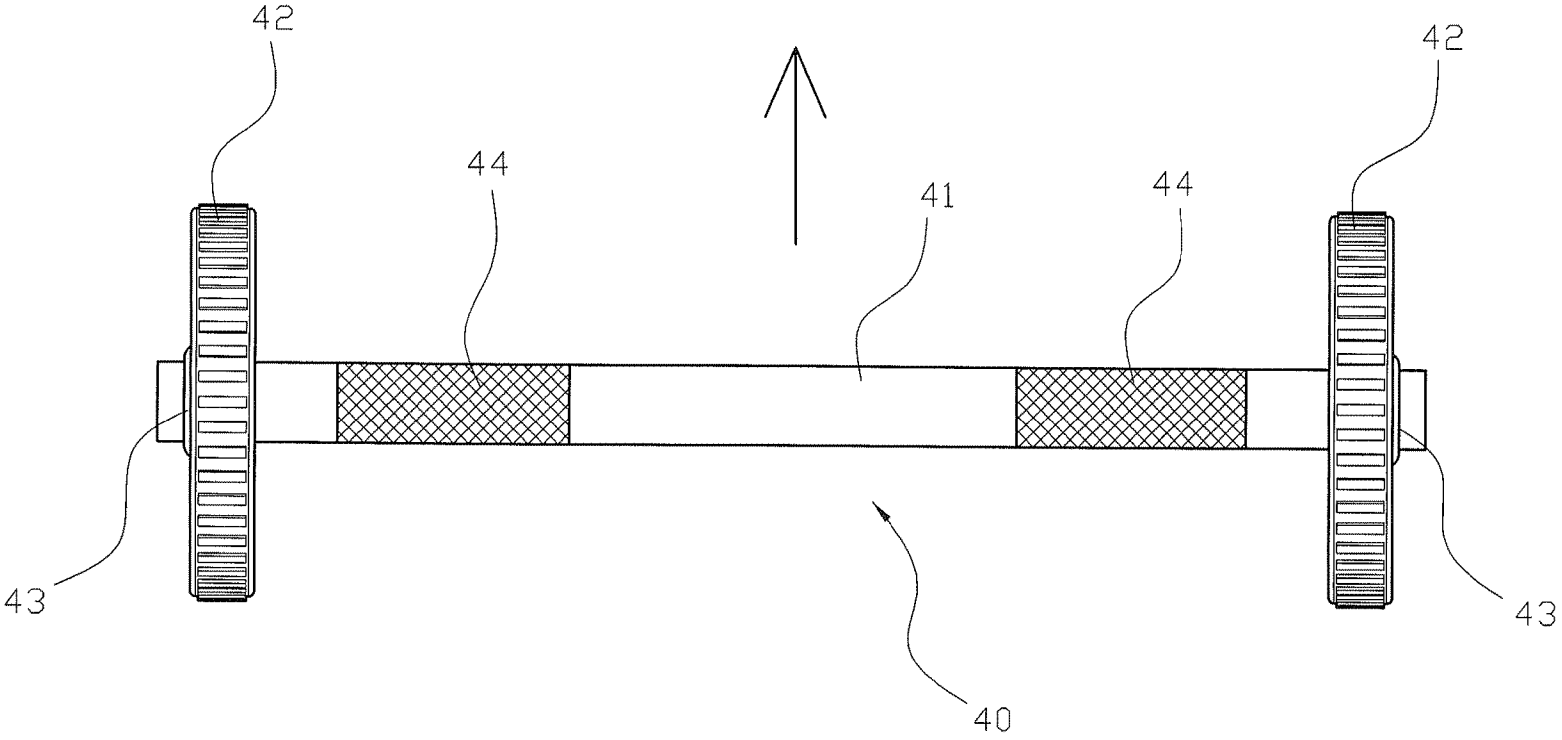
FIG. 11 PRIOR ART
FIG. 11 is a schematic operational view of a conventional wheel exercising device in accordance with the prior art.

Referring to FIGS. 9 and 10, the connecting ring 23 of each of the two handgrips 20 has a periphery formed with a plurality of locking holes 233. The wheel exercising device further comprises two covers 25 each locked on the connecting ring 23 of one of the two handgrips 20 by a plurality of screw members 251 which are screwed into the locking holes 233 of the connecting ring 23 of one of the two handgrips 20. Each of the two covers 25 is provided with a shell 252 extending toward the stop portion 13 of the shank 10 to cover the at least one elastic member 24.

Accordingly, when the two wheels 30 are rotated backward, the two handgrips 20 are moved outward relative to each other, and when the two wheels 30 are rotated forward, the two handgrips 20 are moved toward each other, so that the two handgrips 20 displace sideward on the shank 10 during rotation of the two wheels 30, thereby enhancing variation and amusement of the wheel exercising device during the exercising process, and thereby exercising more part of the user's body, so as to enhance the exercising effect. In addition, the at least one elastic member 24 provides a restoring force to the two handgrips 20 so that the user operates the two handgrips 20 in an energy-saving manner. Further, when respective the boss 151 of the U-shaped elastic plate 15 is pressed and retracted inward to detach from each of the two apertures 321, the two caps 32 are released from the shank 10, so that the two wheels 30 can be removed from the shank 10, the at least one elastic member 24 can be detached from the two handgrips 20, and the two handgrips 20 can be unscrewed from the shank 10, so as to assemble and disassemble the wheel exercising device easily and conveniently.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A wheel exercising device comprising:

a shank;

two handgrips mounted on the shank;

two wheels mounted on the shank; and two caps mounted on the shank and resting on the two wheels;

wherein:

the shank has a surface formed with a first threaded section and a second threaded section having a screwing direction opposite to that of the first threaded section;

the shank is provided with a stop portion located between the first threaded section and the second threaded section;

the shank has two ends each provided with a connecting portion;

each of the two handgrips is formed with a through hole mounted on the first threaded section and the second threaded section of the shank;

the through hole of each of the two handgrips has a peripheral wall formed with an internal threaded section screwed onto the first threaded section and the second threaded section of the shank;

each of the two handgrips is formed with a connecting ring directed toward the stop portion of the shank;

at least one elastic member is connected between the connecting rings of the two handgrips;

each of the two wheels has a center provided with an axial hole mounted on the respective connecting portion of the shank;

each of the two caps is mounted on the respective connecting portion of the shank and rests on one of the two wheels;

when the two wheels are rotated forward and backward, the two handgrips are moved inward and outward synchronously along the first threaded section and the second threaded section of the shank, and the at least one elastic member provides a pulling force between the two handgrips to pull the two handgrips toward the stop portion of the shank.

2. The wheel exercising device of claim 1, wherein each of the two caps is provided with two apertures, and the respective connecting portion of the shank has an interior provided with a substantially U-shaped elastic plate which has two ends each provided with a boss which protrudes from the respective connecting portion and is inserted into each of the two apertures to form a quick release structure between each of the two wheels and the shank.

3. The wheel exercising device of claim 1, further comprising:

two bushings each mounted between the respective connecting portion of the shank and the axial hole of one of the two wheels.

4. The wheel exercising device of claim 1, wherein each of the two wheels is formed with a plurality of spokes extending outward from the axial hole in a radiating manner, and each of the two caps is formed with a plurality of retaining grooves directed toward and mounted on the spokes of one of the two wheels, so that the two caps and the two wheels are rotated synchronously.

5. The wheel exercising device of claim 1, wherein the connecting ring of each of the two handgrips is formed with a plurality of slits arranged in a radiating manner, and each of the slits allows entrance of the at least one elastic member and has a bottom formed with a positioning hole for limiting the at least one elastic member.

6. The wheel exercising device of claim 5, wherein the at least one elastic member is an elastic loop extending through four adjacent positioning holes of the two handgrips.

7. The wheel exercising device of claim 5, wherein the at least one elastic member is a tension spring hooked between two opposite positioning holes of the two handgrips.

8. The wheel exercising device of claim 5, wherein the at least one elastic member is an elastic cord extending through all of positioning holes of the two handgrips.

9. The wheel exercising device of claim 1, wherein the connecting ring of each of the two handgrips is formed with a plurality of positioning holes for fixing the at least one elastic member.

10. The wheel exercising device of claim 9, wherein the at least one elastic member is a tension spring hooked between two opposite positioning holes of the two handgrips.

11. The wheel exercising device of claim 9, wherein the at least one elastic member is an elastic cord extending through all of positioning holes of the two handgrips.

12. The wheel exercising device of claim 1, wherein:

the connecting ring of each of the two handgrips has a periphery formed with a plurality of locking holes;

the wheel exercising device further comprises two covers each locked on the connecting ring of one of the two handgrips by a plurality of screw members which are screwed into the locking holes of the connecting ring of one of the two handgrips; and each of the two covers is provided with a shell extending toward the stop portion of the shank to cover the at least one elastic member.

* * * * *